US007679293B2

(12) United States Patent
Xie et al.

(10) Patent No.: US 7,679,293 B2
(45) Date of Patent: Mar. 16, 2010

(54) ANTI-STRIATION CIRCUIT FOR CURRENT-FED BALLAST

(75) Inventors: Xuefei Xie, Shanghai (CN); Gang Yao, Shanghai (CN); Chenghua Zhu, Shanghai (CN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/960,843

(22) Filed: Dec. 20, 2007

(65) Prior Publication Data

US 2009/0160347 A1 Jun. 25, 2009

(51) Int. Cl.
*H05B 37/02* (2006.01)

(52) U.S. Cl. ..... 315/209 R; 315/219; 315/224; 315/274; 315/291

(58) Field of Classification Search ..... 315/224, 315/225, 247, 246, 209 R, 219, 291, 307, 315/274–279

See application file for complete search history.

(56) References Cited

U.S. PATENT DOCUMENTS

| | | | | |
|---|---|---|---|---|
| 4,682,082 | A | 7/1987 | MacAskill et al. | |
| 5,001,386 | A | 3/1991 | Sullivan et al. | |
| 5,034,660 | A | 7/1991 | Sairanen | |
| 5,691,606 | A * | 11/1997 | Moisin et al. | 315/307 |
| 5,798,617 | A * | 8/1998 | Moisin | 315/247 |
| 6,756,747 | B2 | 6/2004 | Hsieh | |
| 6,836,077 | B2 | 12/2004 | Nerone | |
| 2005/0168171 | A1 * | 8/2005 | Poehlman | 315/291 |
| 2006/0097666 | A1 | 5/2006 | Venkitasubrahmanian et al. | |
| 2006/0103328 | A1 | 5/2006 | Chen et al. | |
| 2008/0129216 | A1 * | 6/2008 | Fang et al. | 315/219 |

FOREIGN PATENT DOCUMENTS

| | | | |
|---|---|---|---|
| EP | 0547674 | A1 | 6/1993 |
| EP | 0765107 | A1 | 3/1997 |
| EP | 0852453 | A1 | 7/1998 |
| EP | 1265461 | A2 | 12/2002 |
| EP | 1269801 | B1 | 12/2003 |
| WO | WO 98/09484 | | 3/1998 |
| WO | WO 01/76325 | A1 | 10/2001 |
| WO | WO 2006/051495 | A1 | 5/2006 |

* cited by examiner

*Primary Examiner*—Tuyet Vo
(74) *Attorney, Agent, or Firm*—Fay Sharpe LLP

(57) ABSTRACT

An electronic ballast circuit having at least two distinct switching cycles also includes an anti-striation feature. More particularly the electronic ballast includes an input section configured to receive an input from a power source. A resonant section receives the signals from the input section in order to generate a resonant signal. An anti-striation component is connected within the electronic ballast circuit to affect operation of the resonant section, which results in an affected resonant signal. A switching arrangement is configured to receive the affected resonant signal from the resonant section and anti-striation component, and is further configured to generate an asymmetric output signal due to the affects of the anti-resonant component, wherein the anti-striation component causes parameters of the resonant section of the electronic ballast circuit to be different for different switching cycles of the electronic ballast circuit. An output section is provided to output the asymmetric output signal to a lamp system.

20 Claims, 14 Drawing Sheets

P4:min(C2)
846 mA
P3:mean(C2)
15 mA
P2:ms(C2)
543 mA
P1:max(C2)
922 mA
MEASURE
VALUE
STATUS
C1
C2
36
38
40
42

P1:max(F2)
868 mA
P2:ma(C1)
237.1 V
P3:mean(F2)
485 mA
P4:min(F2)
0.00 mA
P5:max(F1)
345 V
P6:min(F1)
0 V
70
72
74
74

ANTI-STRIATION CIRCUIT FOR CURRENT-FED BALLAST

BACKGROUND OF THE INVENTION

The present application is related to electronic ballasts, and more particular to current-fed electronic ballasts designed to eliminate or minimize the striation phenomenon which can occur in gas discharge type lamps.

A gas discharge lamp converts electrical energy into visible energy by utilizing an electronic ballast to provide an alternating current flow through a gas discharge lamp. During operation of a gas discharge lamp, a phenomenon known as striations can occur. Striations can be seen in all types of gas discharge lamps, as zones of differing light intensity, causing the appearance of dark bands. This phenomenon results in an undesirable strobing effect in the lamp. In general, the lower the environment temperature, the more pronounced the striation effect. However, certain lamps will show striations at higher temperatures, including that of room temperature. This situation is particularly an issue with a newer type of energy saving lamps, which employ certain classes of gasses such as krypton.

It is well known that providing an asymmetrical current waveform through the gas discharge lamp can effectively eliminate or minimize visible striations. Based on this understanding, the lighting industry has implemented a variety of anti-striation ballast circuit configurations.

Examples of various proposed solutions include:

US2006/0103328A1, published May 18, 2006, by General Electric, which teaches the addition of an auxiliary winding on a DC choke connected in series with the common end of the lamps to generate even harmonic current component into lamp current, to reduce or eliminate striation;

WO2006/051495A1, U.S. Pat. No. 6,756,747B2, U.S. Pat. No. 6,836,077B2, U.S. Pat. No. 4,682,082, EP852453A1, EP765107A1, teach generating an asymmetrical driver to control the two switches of the circuit, to control a flow of an asymmetrical current waveform through the lamps;

US2005/0168171A1, published Aug. 4, 2005, by an individual applicant, uses an unbalanced circuit component (an unbalanced output transformer or an unbalance DC choke) to produce asymmetric lamp current, to control striation;

US2006/0097666A1, EP547674A1, WO01/76325A1, EP1269801B1, EP1265461, teaches the addition of a striation correction circuit to inject a DC component directly into the lamp current; and WO98/09484, published Mar. 5, 1998, by Philips Electronics, is directed to producing an asymmetric filament voltage between its opposite polarities to reduce striation, where the anti-striation circuit can be realized with low voltage components.

The above do provide various attempts to address the striation problem. However, these proposals present various disadvantages, such as but not limited to, the introduction of DC bias which leads to a shorter lamp life, as well as complicated and/or expensive circuitry. Therefore, it has been considered desirable to find an effective solution to the striation problem, without degrading the performance of the gas discharge lamp system, which also does not substantially increase the cost, particularly when used in association with energy saving high efficiency lamps.

BRIEF DESCRIPTION OF THE INVENTION

An electronic ballast circuit having at least two distinct switching cycles also includes an anti-striation feature. More particularly the electronic ballast includes an input section configured to receive an input from a power source. A resonant section receives the signals from the input section in order to generate a resonant signal. An anti-striation component is connected within the electronic ballast circuit to affect operation of the resonant section, which results in an affected resonant signal. A switching arrangement is configured to receive the affected resonant signal from the resonant section and anti-striation component, and is further configured to generate an asymmetric output signal due to the affects of the anti-resonant component, wherein the anti-striation component causes parameters of the resonant section of the electronic ballast circuit to be different for different switching cycles of the electronic ballast circuit. An output section is provided to output the asymmetric output signal to a lamp system.

DETAILED DESCRIPTION OF THE INVENTION

Figure 1:
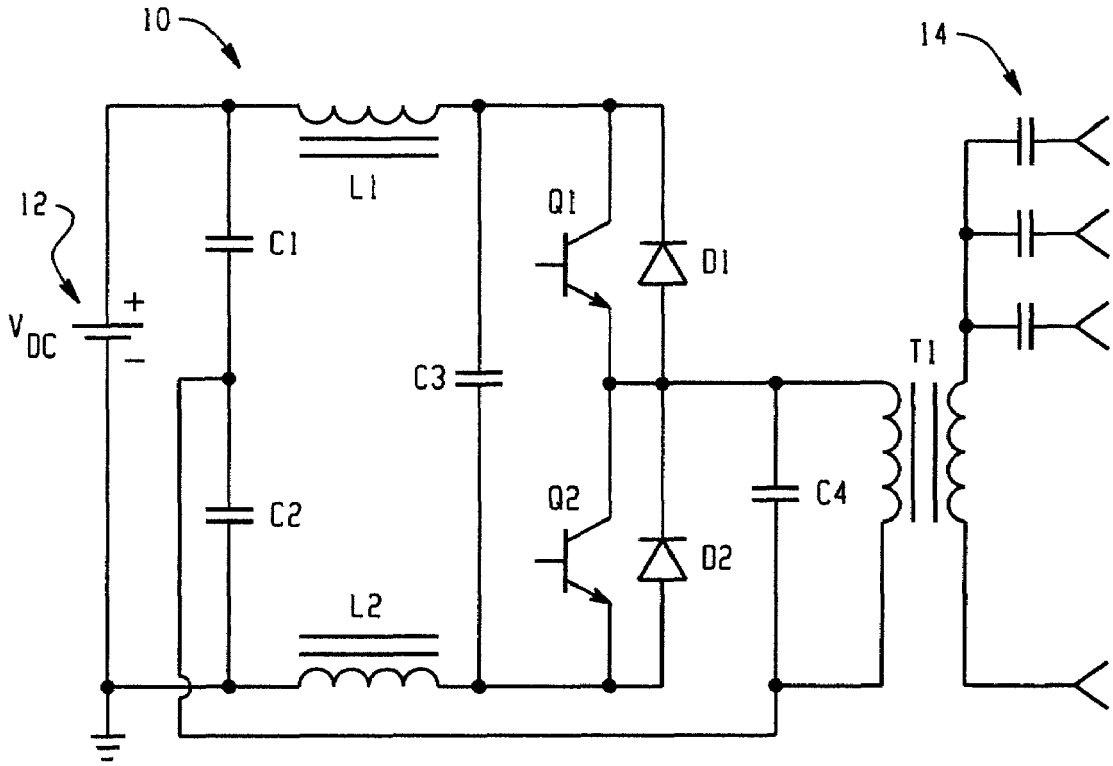
Fig. 1 PRIOR ART
FIG. 1 is a prior art circuit diagram of a current-fed, half-bridge ballast topology.

With particular attention to FIG. 1 shown is a prior art current-fed half-bridge inverter ballast 10, supplied by a power source such as DC power source 12, and used to feed a lamp system 14. FIG. 1 employs a known current-fed topology, having an input section defined by the terminals connected to C1 and C2, a DC choke comprised of capacitors C1 and C2, and bus inductors L1 and L2. A system capacitor C3 connected across half bridge switches Q1 and Q2, and diodes D1 and D2 connected across switches Q1 and Q2. Resonant capacitor C4 is connected back to the DC choke between C1 and C2, and is connected at its other end across the primary winding of transformer T1, wherein the secondary of T1 is connected to lamp system 14. The primary of T1 and capacitor C4 are part of a resonant tank section of the circuit. Finally, an output or output line is found between the switches Q1 and Q2 and connects to the primary of transformer T1.

An issue with a current-fed topology such as ballast 10 of FIG. 1, is its generation of striations in lamps of lamp system 14 which may occur when gas discharge lamps are used, and which are a particular problem when high efficiency energy saving lamps are part of lamp system 14.

A variety of theories have taken the position striations occur as a result of high-frequency currents re-enforcing a standing wave of varying charge distributions between the lamp electrodes. As previously noted, experimentation has shown that by introducing asymmetric lamp current to the circuit, elimination or minimization of the striation phenomenon can be achieved. The circuit configurations that follow provide unique structural arrangements to induce asymmetric lamp current in various generally known ballast circuits, such as current-fed half-bridge or push-pull technologies, to thereby eliminate or minimizing the visible striations in gas discharge lamps of the lamp system. Among the concepts employed by the to-be-described circuits is the idea of generating the asymmetric current by changing the design and operation of the resonant portion of the circuit instead of, for example, changing the base drive impedance.

Figure 2:
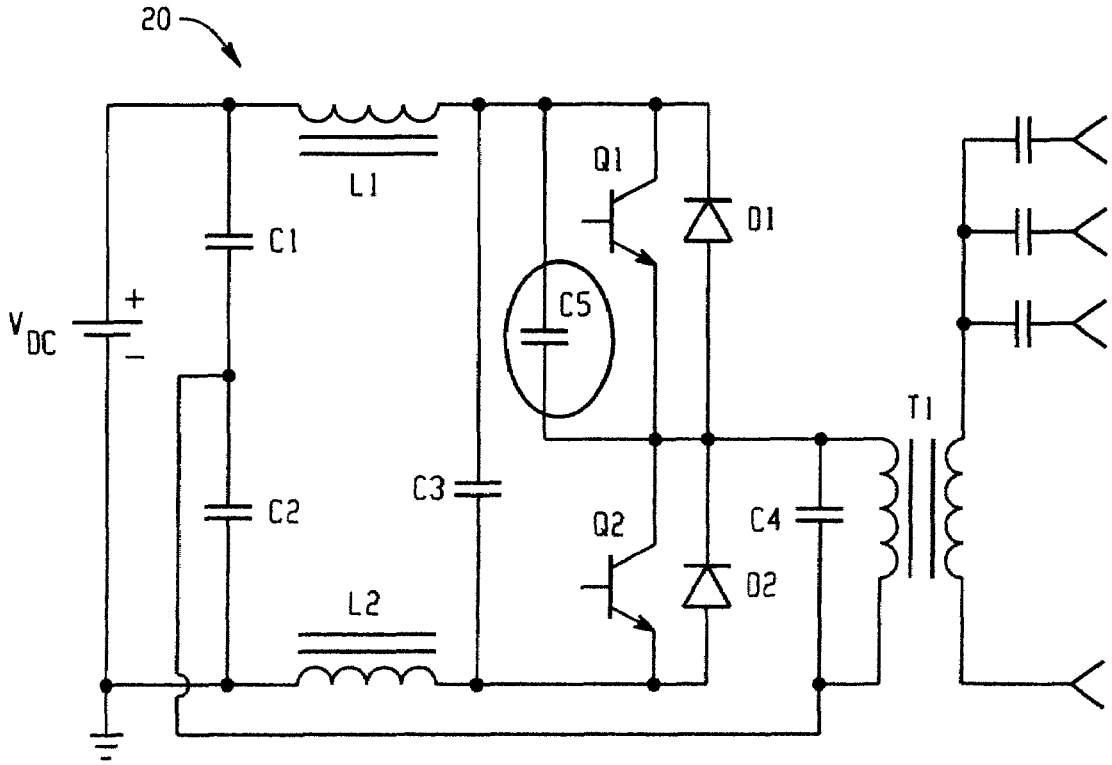
FIG. 2 illustrates an embodiment of an anti-striation circuit for an electronic ballast in accordance with the present application.

FIG. 2 illustrates a first embodiment for a current-fed half-bridge topology 20 where at least one additional resonant component is added to change the resonant tank parameters between the first half-switching cycle and the second half-switching cycle of the circuit. More particularly, in this embodiment capacitor C5 (such as a 0.5 n capacitor) is connected across switch Q1 of the half-bridge. As explained below, addition of C5 changes the configuration of the resonant tank portion of the circuit creating an asymmetric current for the lamp system.

Figure 3:
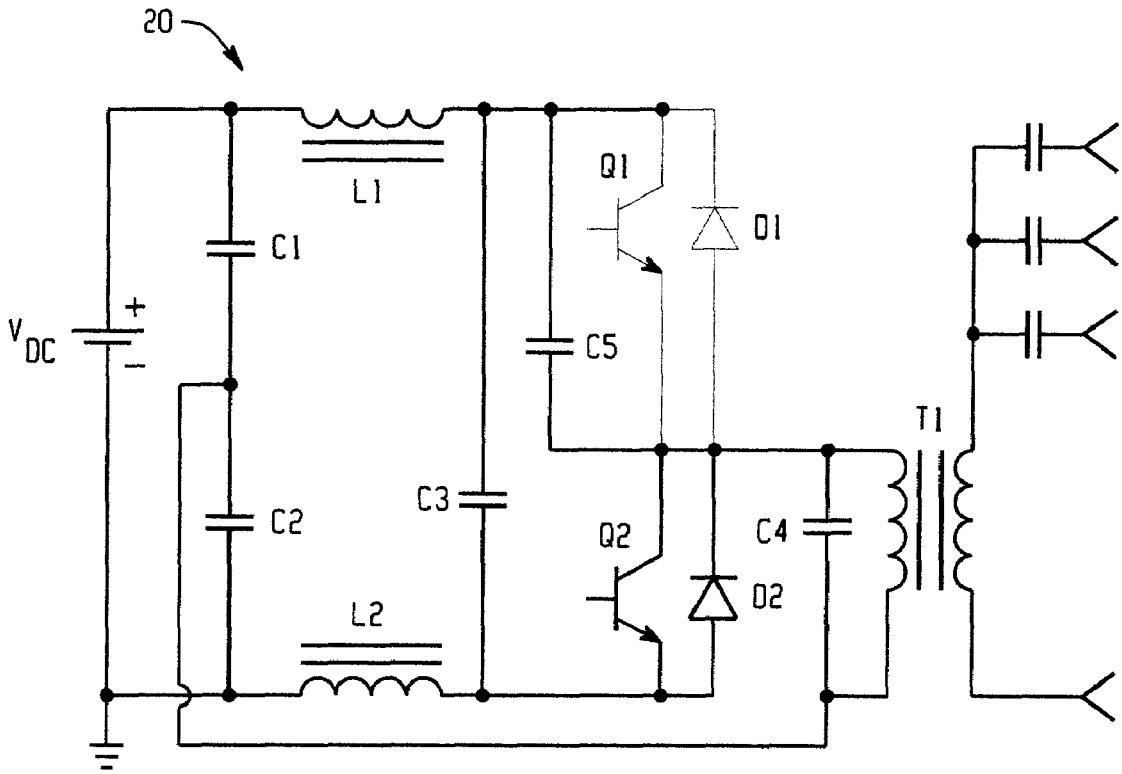
FIG. 3 illustrates the first half-cycle of the resonant circuit of FIG. 2.
Figure 4:
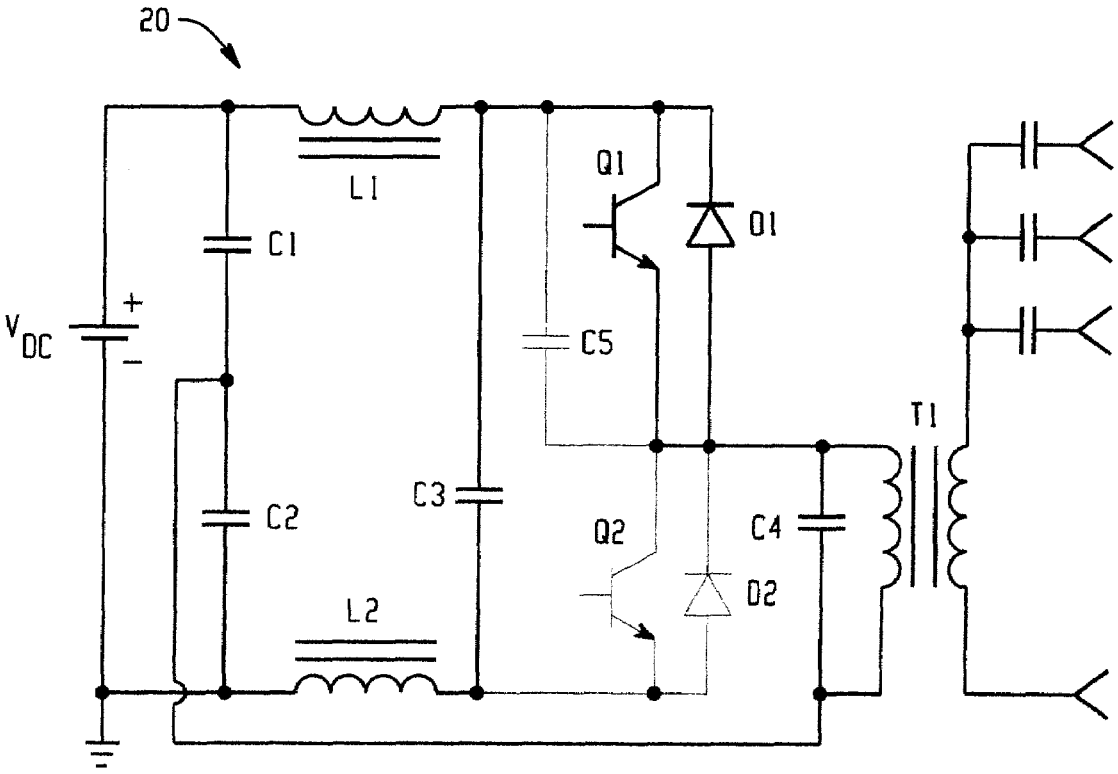
FIG. 4 depicts the second half-cycle resonant circuit of FIG. 2.

FIGS. 3 and 4 detail operational principles of circuit 20 of FIG. 2. FIG. 3 depicts the first half-cycle of the resonant circuit, including resonant capacitor C5, where switch Q1 is OFF. In this portion of the circuit operation, capacitor C5 is active in conjunction with switch Q2. The inactive aspect of switch Q1 and diode D1 are illustrated by the lighter drawn lines. Then as shown in FIG. 4 when switch Q1 is active, capacitor C5 is essentially inactive due to switch Q1 being ON or active, during the second resonant half cycle. Introduction of resonant capacitor C5 changes the relationship of the resonant circuit and introduces asymmetric outputs from switches Q1 and Q2, and in turn an asymmetric current signal is supplied to the lamps of lamp system 14, thereby avoiding striation effects without changing the duty cycle of switches Q1 and Q2.

Figure 5A:
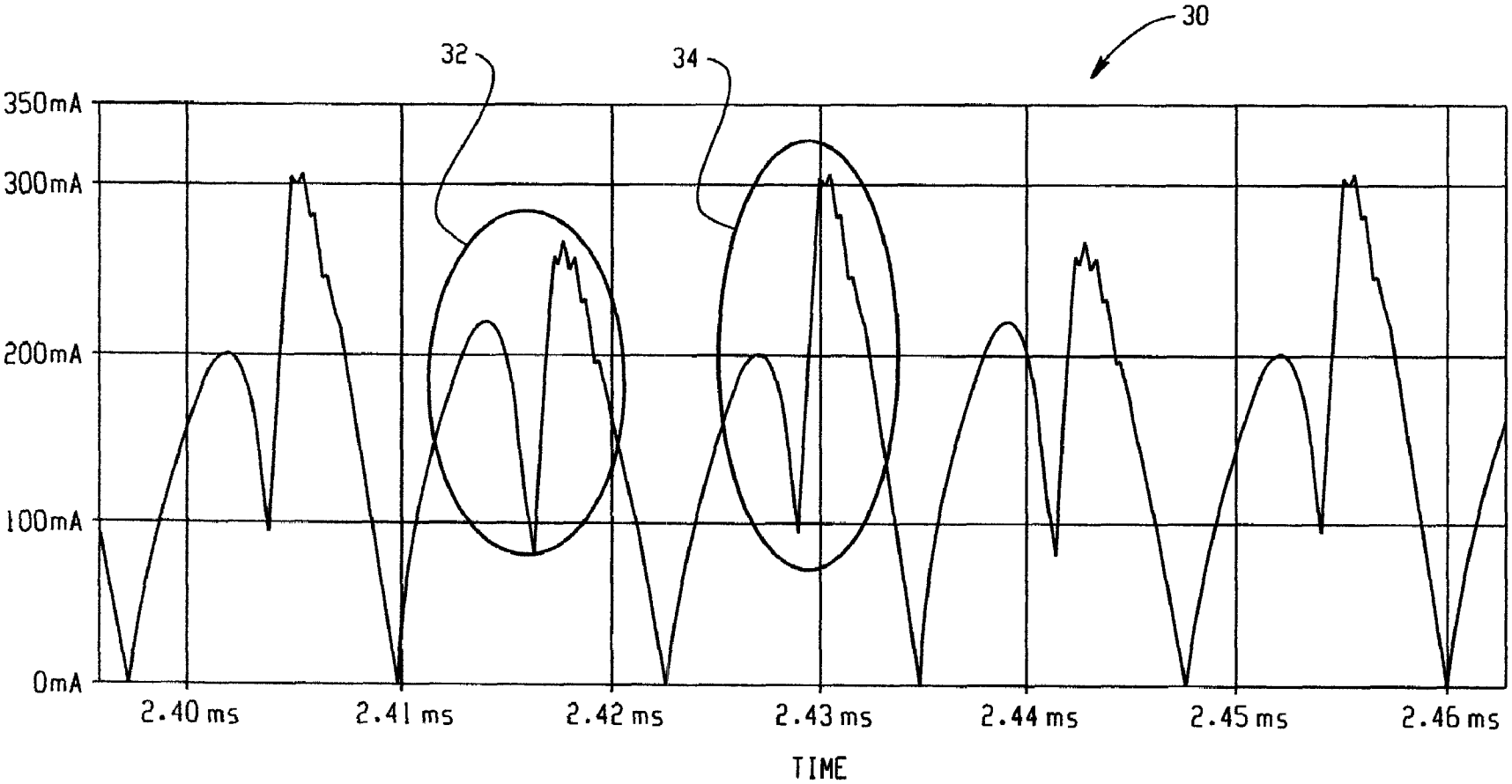
FIG. 5A illustrates a simulation waveform for lamp current for the circuit of FIG. 2.
Figures 5B, 5C:
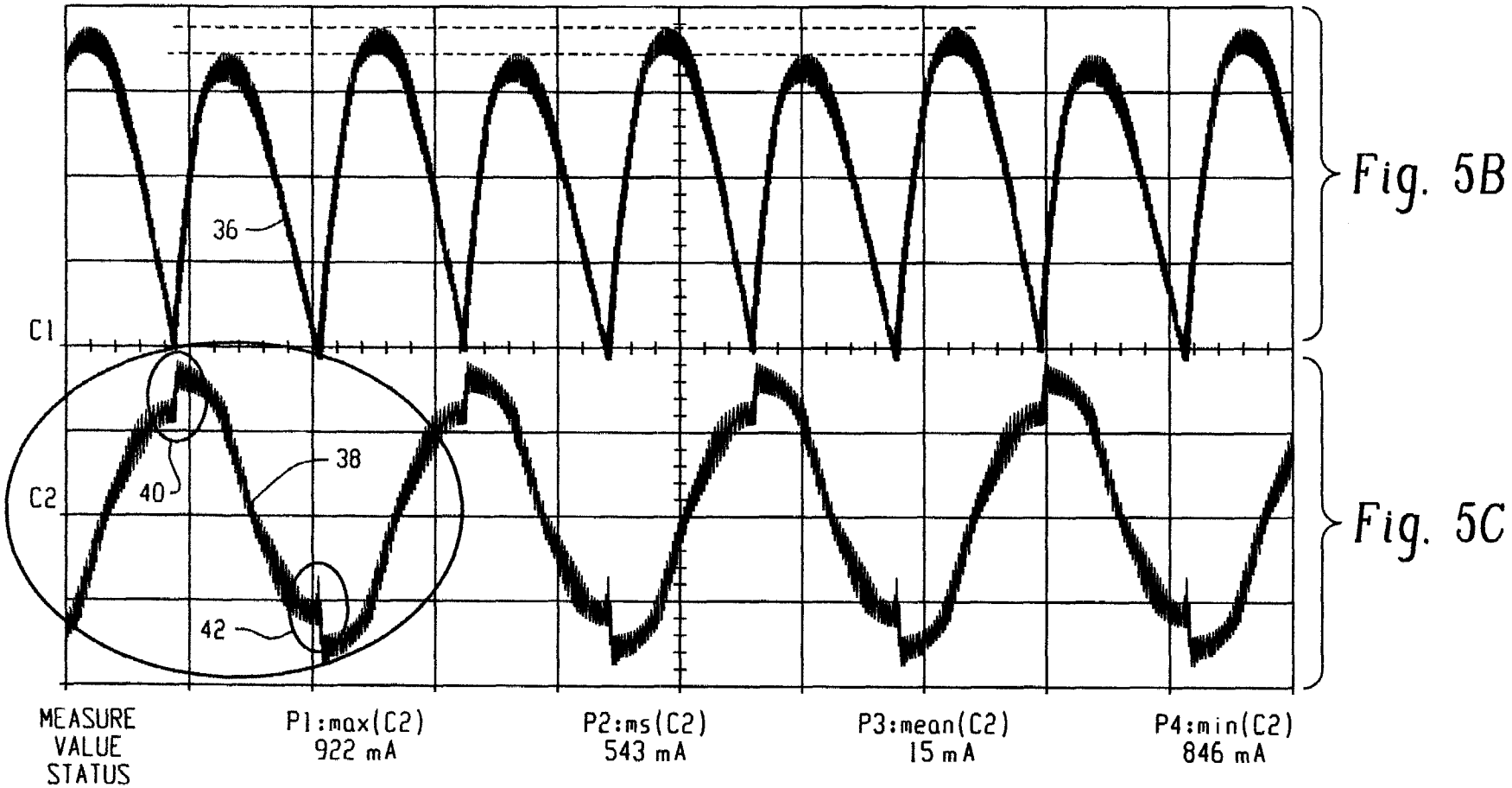
FIGS. 5B and 5C depict experimental waveform results for the circuit of FIG. 2.

Turning to FIGS. 5A-5C, simulation and experimental waveforms reflecting the circuit design of FIG. 2 are illustrated. In FIG. 5A simulation waveform 30 of the lamp current (absolute value) is depicted with asymmetric portions highlighted by areas 32 and 34. These areas clearly show the asymmetric output caused by use of capacitor C5. The existence of the asymmetric current, again, permits for the elimination or minimization of the striations which would otherwise occur, particularly when using the ballast circuit of FIG. 2 in connection with high efficiency type gas discharge lamps.

Circuit 20 of FIG. 2, has been implemented experimentally by the use of an Ultrastart 4L ballast from General Electric having a capacitor, such as capacitor C5, added in parallel with switch Q1. This newly configured ballast was then connected with an F28 lamp and placed in a low temperature chamber. It was found that for temperatures above 0° C., there was no visible flickering or striation. When the low temperature chamber temperature dropped to −10° C., there were only minor striations. It is considered by the inventors that increasing the added resonant parallel capacitance will achieve anti-striation at even lower temperatures.

Waveforms 36 and 38 obtained by this experimentation are shown in FIGS. 5B and 5C, where FIG. 5B depicts a waveform 36 across capacitor C3, and waveform 38 is the experimental lamp current having the previously noted asymmetry highlighted 40,42.

Figure 6:
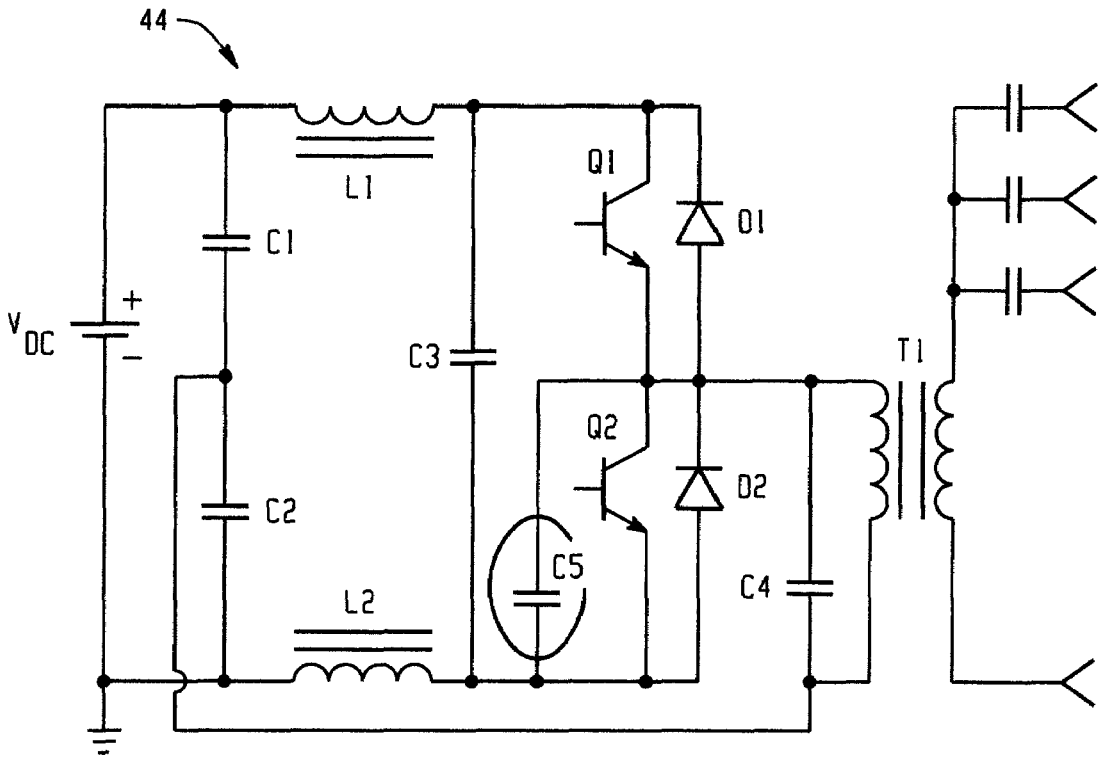
FIG. 6 illustrates an embodiment of another anti-striation circuit in accordance with the present application.

It is to be appreciated the concept of altering the resonant tank parameters by incorporation of an additional resonant component, in this embodiment capacitor C5, may be achieved at other locations within the resonant circuitry. More particularly, in another embodiment illustrated in FIG. 6, capacitor C5 may be placed in parallel with half-bridge switch Q2 of circuit 44. In this design, actions opposite those from the actions discussed in connection with FIGS. 3 and 4 will occur.

Figure 7:
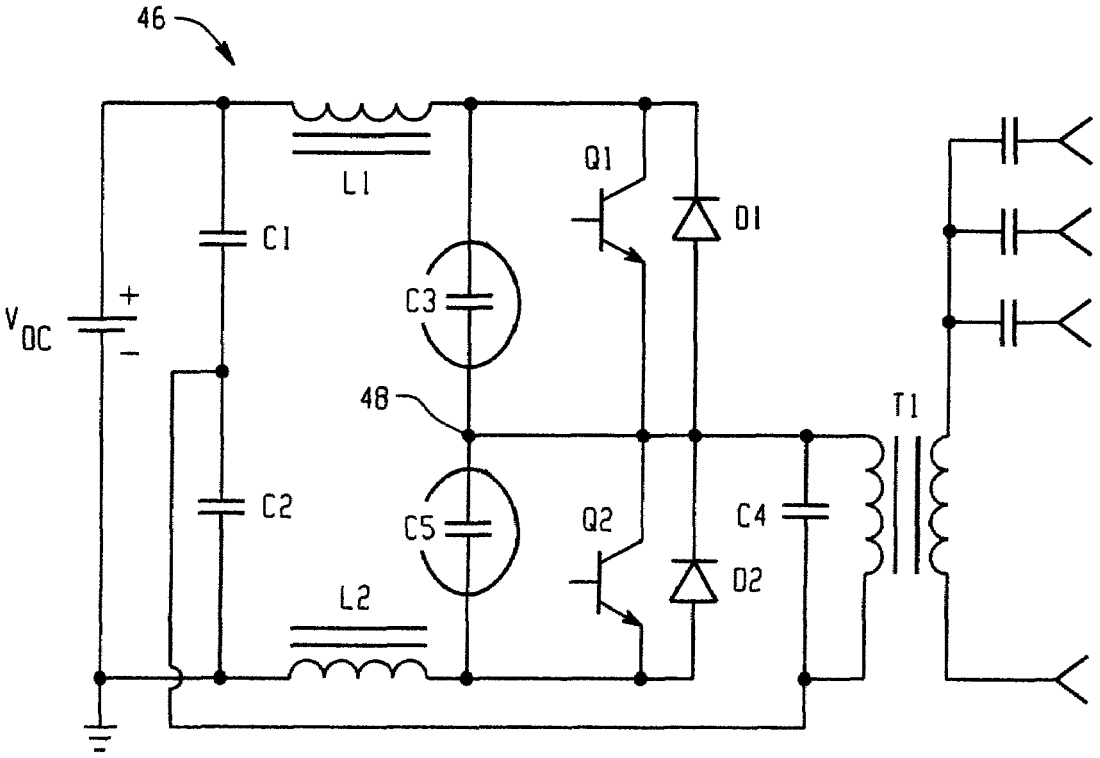
FIG. 7 depicts another embodiment of an anti-striation circuit in accordance with the present application.

FIG. 7 shows still another embodiment of an electronic ballast circuit 46 incorporating anti-striation features in accordance with the present application. In this embodiment, the additional resonant component capacitor C5 is placed in relationship to capacitor C3 such that they are connected at a center point 48 of the circuit output line to transformer T1. In this embodiment the imbalance in the resonant circuit is obtained by having capacitors C3 and C5 selected to have different values.

Figure 8:
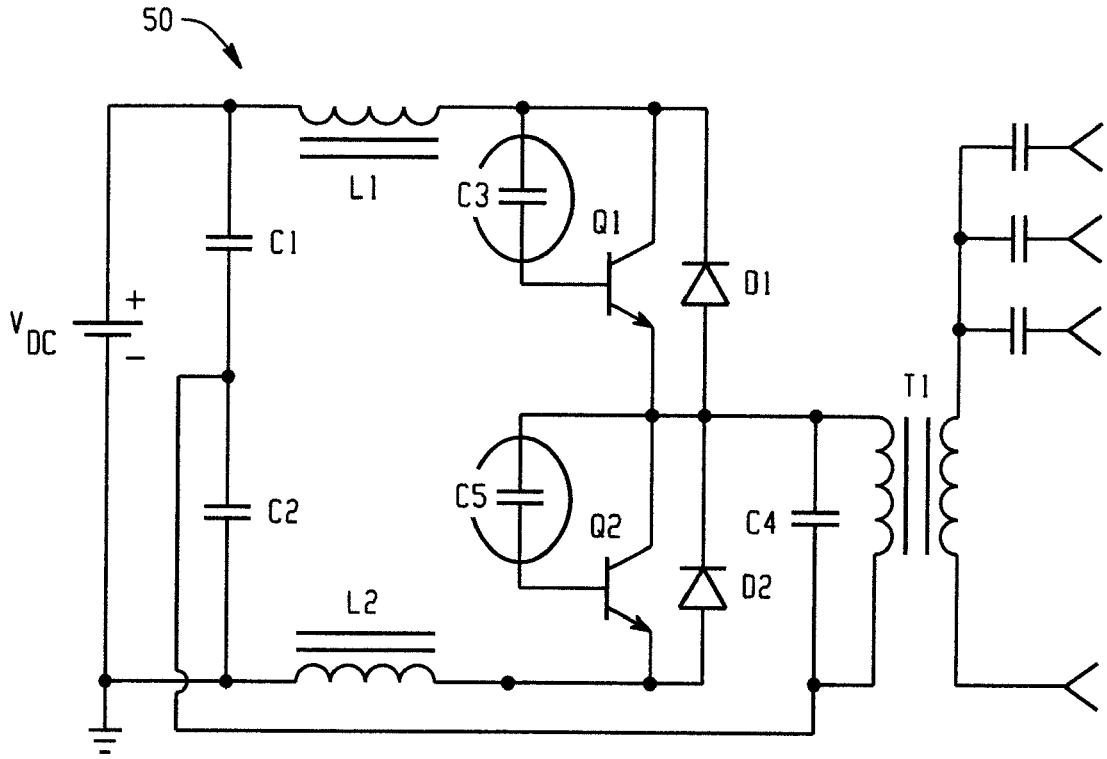
FIG. 8 depicts still a further embodiment of an anti-striation circuit according to the present application.

Turning to FIG. 8, depicted is still a further embodiment of an anti-striation circuit for electronic ballast 50 in accordance with the present application. In this design capacitor C3 is connected to the upper bus and the input of switch Q1, and capacitor C5 is connected to the input of switch Q2, and capacitor C4 and the primary winding of T1.

Figure 9:
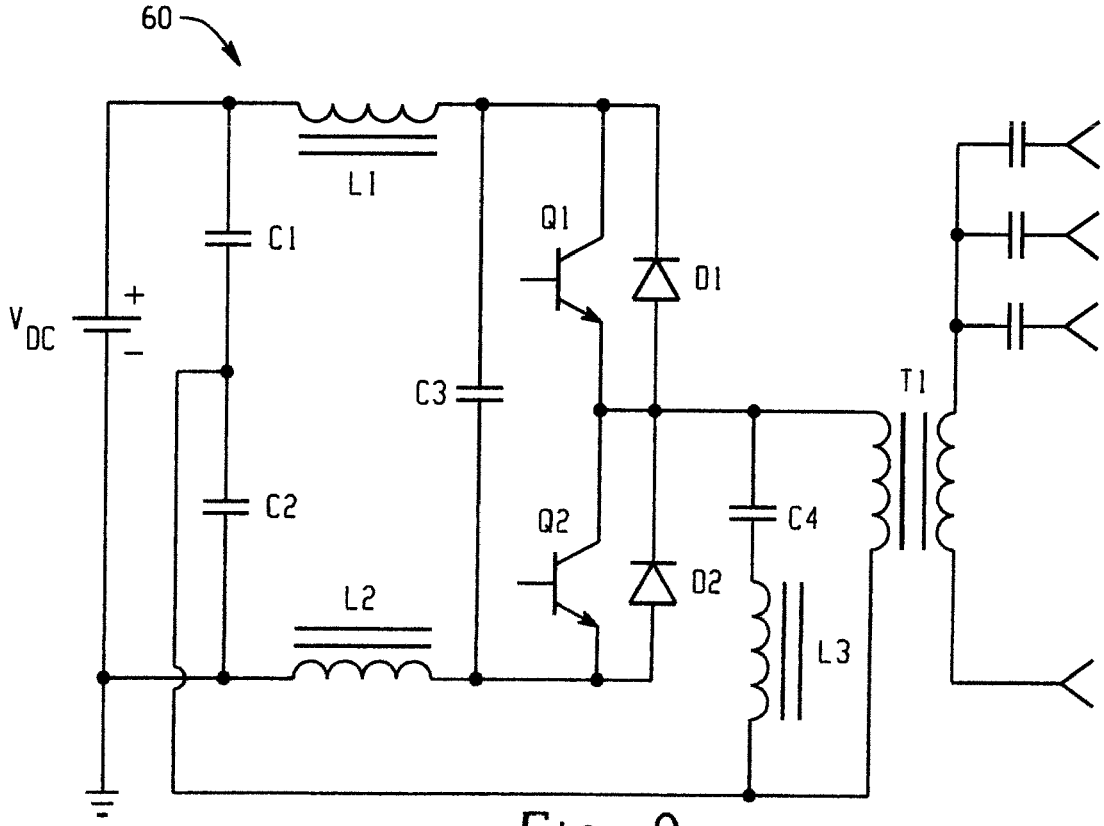
FIG. 9 depicts still another further embodiment for an anti-striation circuit of the present application.

FIG. 9 shows a new embodiment of the present application where a current-fed, half-bridge ballast circuit topology 60 incorporates an auxiliary winding L3 coupled to inductors L1, L2 of the DC choke. Inclusion of auxiliary winding L3 results in different resonant inductance between the $1^{st}$ half switching cycle and $2^{nd}$ half switching cycle of circuit 60, which in turn generates an asymmetric lamp current used to minimize or eliminate striations. More particularly, when upper switch Q1 is turned ON, L1 (a winding of the DC choke) and inductor L3 are connected in a same phase/anti-phase arrangement, and the equivalent inductance is increased/decreased due to the effect of mutual inductance. Alternatively, when the lower switch Q2 is turned ON, L2 (a winding of the DC choke) and L3 are connected in anti-phase/ same phase arrangement, then the equivalent inductance is decreased/increased also due to the effect of mutual inductance. Because of the different resonant inductance between the two switching cycles, an asymmetric voltage is generated on the primary winding of output transformer T1. This results in an asymmetric alternating current flow through the lamp system 14, eliminating visual striations occurring in the lamps of the lamp system.

Figure 10A:
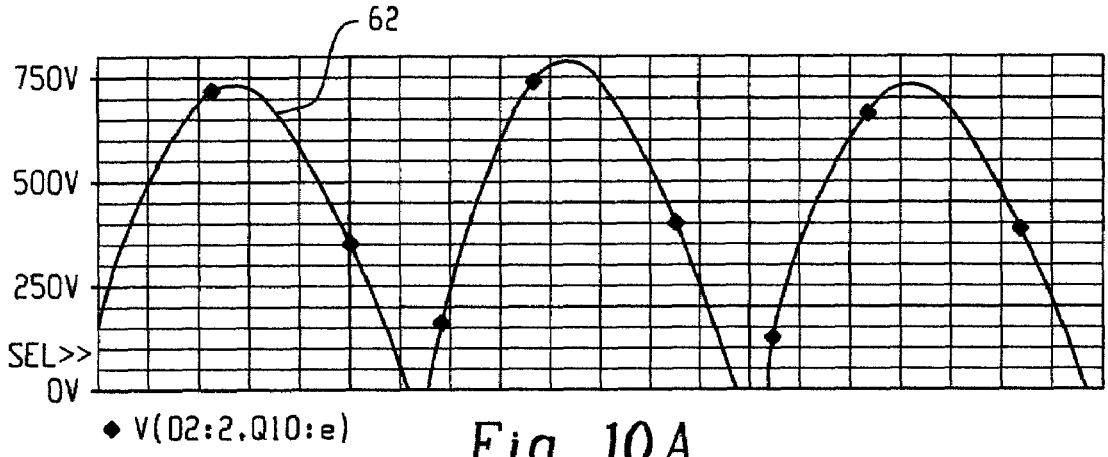
FIGS. 10A-10C depict simulation waveforms in accordance with the circuit of FIG. 9.
Figure 10B:
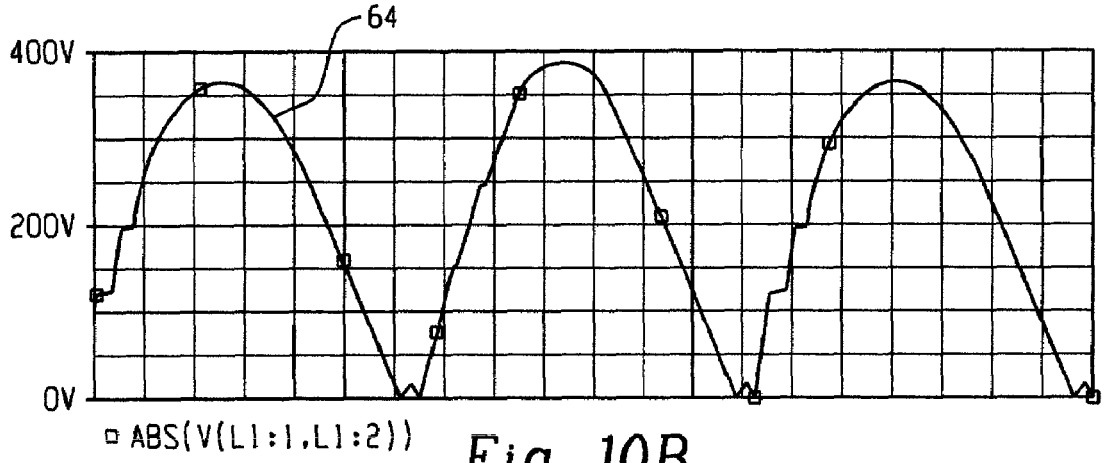
Figure 10C:
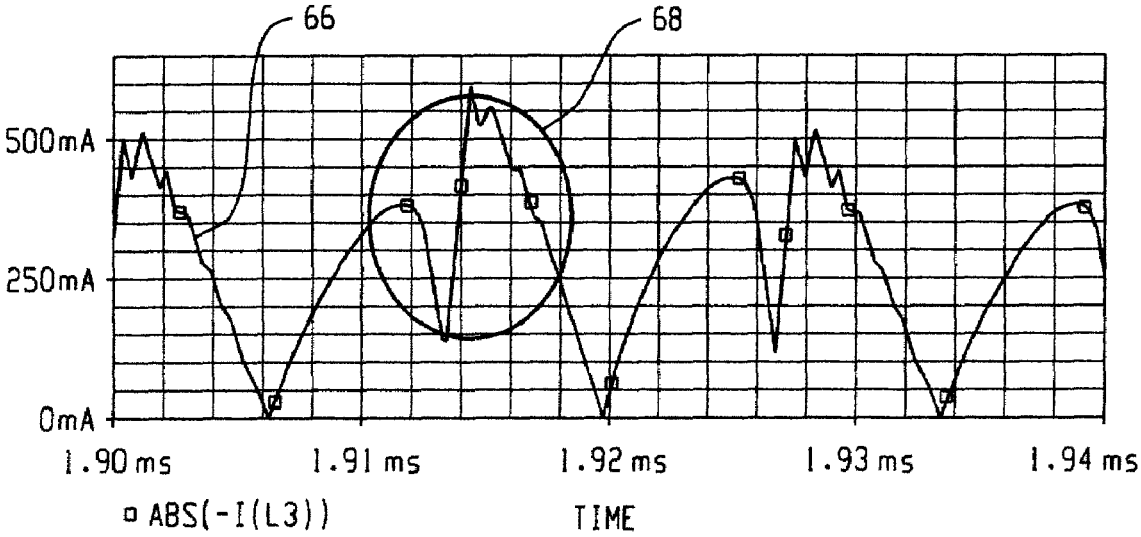

The concepts taught by circuit 60 of FIG. 9 were both simulated and experimentally undertaken. The waveforms of the simulation and experiments are illustrated in FIGS. 10A-10E. FIG. 10A illustrates simulated voltage waveform 62 found on capacitor C3. FIG. 10B illustrates a voltage waveform 64 from on the primary winding of the output transformer (absolute value) T1. FIG. 10C sets forth a simulated lamp current waveform 66 through the common line (absolute value) which is asymmetric, as illustrated by the area in the highlighted circle 68.

Turning to FIG. 10D, waveform 70 again shows the voltage waveform on the primary winding of the output transformer T1 (absolute value), but as obtained from the experimental circuit.

Figures 10D, 10E:
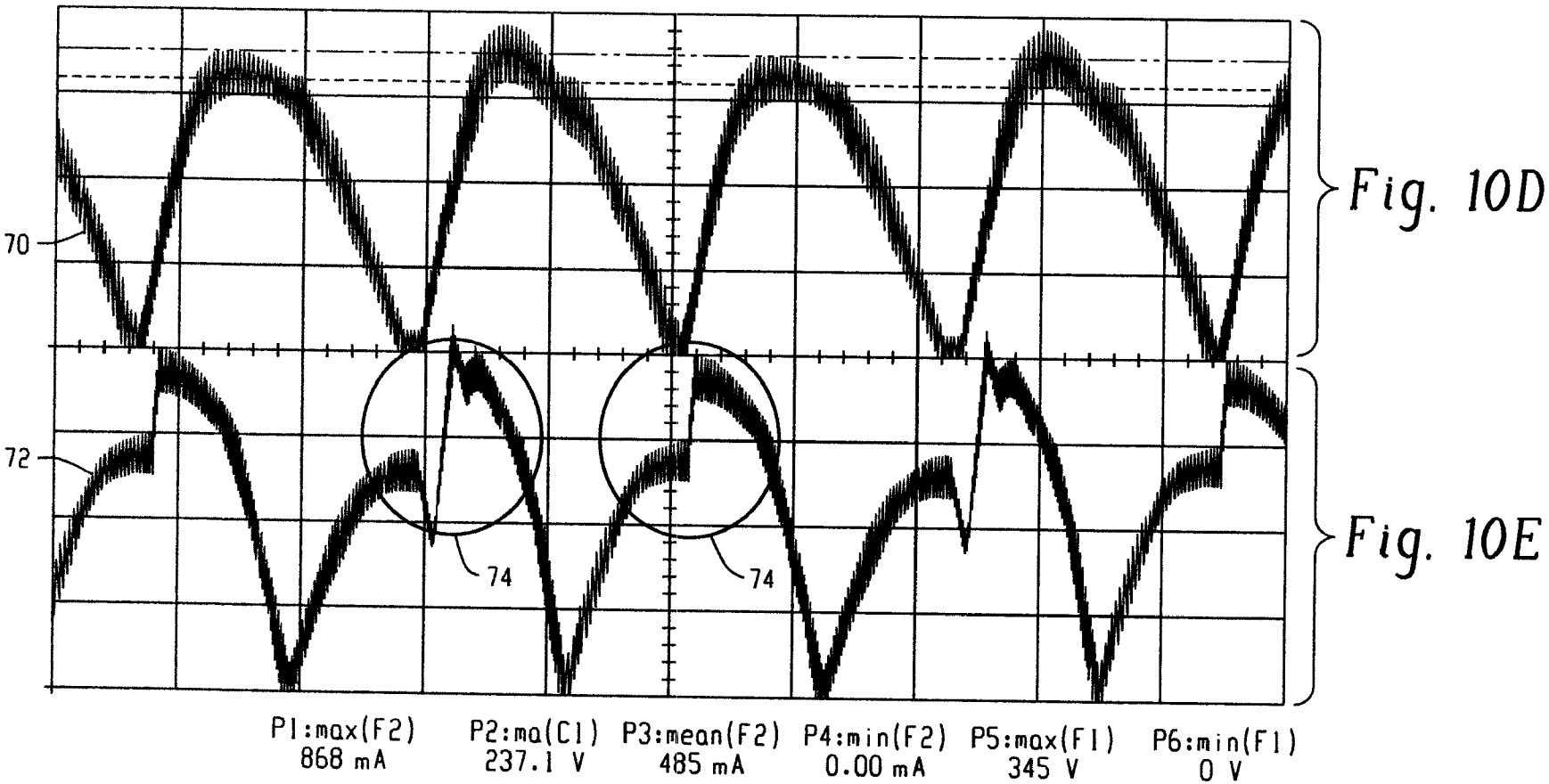
FIGS. 10D and 10E depict experimental waveforms generated by a circuit of FIG. 9.

Finally, FIG. 10E illustrates an experimentally obtained lamp current waveform 72 from the common line (absolute value). The obvious asymmetric aspects of this current waveform are illustrated in the highlighted circled portion 74.

With regard to the experiment, again an Ultrastart 4L ballast was used as the baseline ballast. A 27 uH auxiliary winding L3 was coupled from the DC choke in series with resonant capacitor C4. The ballast circuit output was connected to a F28 lamp, which is known as a high-efficiency lamp, and the lighting arrangement was placed into a low temperature chamber. It was determined that for temperatures above 0° C., no visible striation was found. When the temperature in the low temperature chamber dropped to −10° C., only minor striations were found at the end of the lamps.

It has been discovered by the inventors the auxiliary winding as illustrated in FIG. 9, which is shown coupled from the DC choke, can in fact be connected at a variety of locations when used in a current-fed topology as shown in FIG. 9, to change the configuration of the resonant tank output to an asymmetric output. More particularly, as illustrated by circuit 80 of FIG. 11, block designations B-I represent other locations within such a topology for connection of the auxiliary winding which will result in an asymmetric lamp current. Block designation A is the same as the arrangement of FIG. 9. Such a finding also points out there is no relationship to the phase of the circuit as related to the present concepts.

Figure 11:
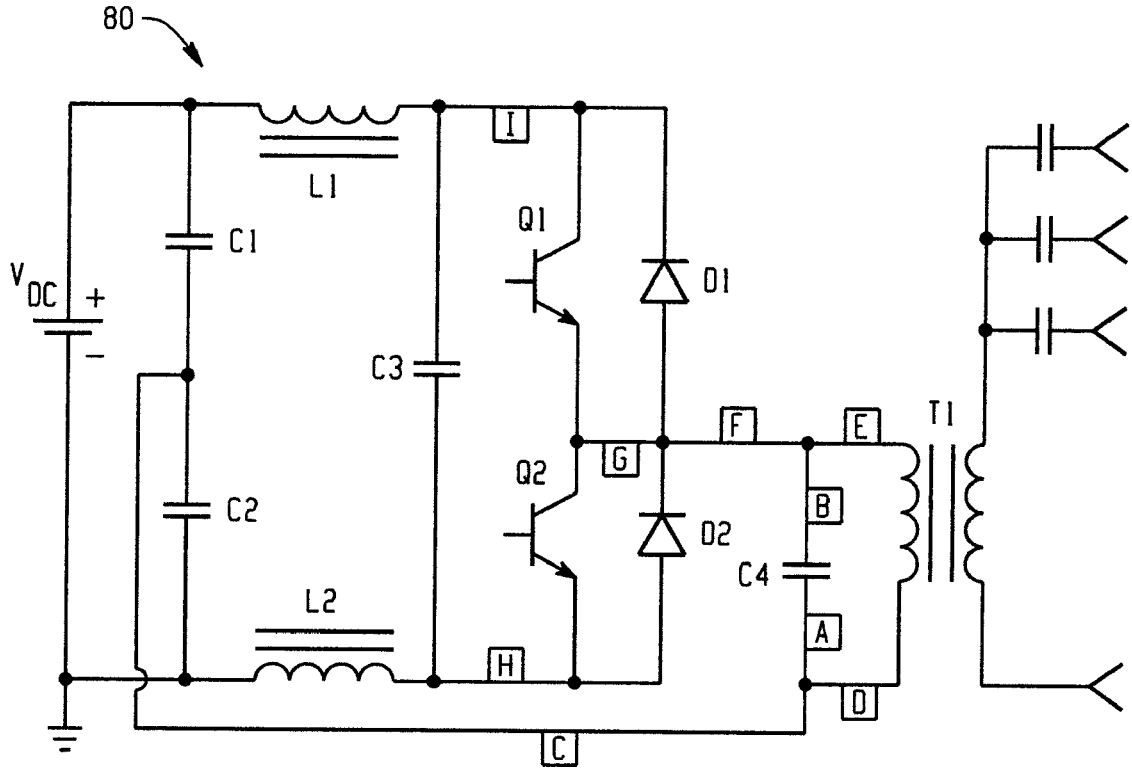
FIG. 11 provides a plurality of auxiliary winding positions for embodiments based on the solutions described in connection with FIG. 9.

To more explicitly describe FIG. 11, each of blocks A-I represent locations where an auxiliary winding (such as L3) may be connected. Thus, block B corresponds to an embodiment where the auxiliary winding L3 is placed between capacitor C4, and the output line to the primary of the winding T1. The auxiliary winding of block C is found in the return line, the auxiliary winding of block D is at the output for the bottom of the primary winding to the return line, the auxiliary winding of block E is at the upper portion of the primary of T1 and the junction between the C4 and output from switches Q1 and Q2. The auxiliary winding of block F embodiment has the inductor found to the left of the connection point of capacitor C4 and the line to the primary of T1, and the connection point between diodes D1 and D2 of the output line. The embodiment of the auxiliary winding of block G is at the output of connection Q1 and Q2 to the connection point between D1 and D2. The embodiment represented by block H has the auxiliary winding at the emitter output of Q2, and the node between L2 and C3. Finally, the embodiment represented by block I has the auxiliary winding coupled at the connection point of C3 and L1 at one side, and at the collector of Q1 on the other.

It is to be noted in this description only one of the auxiliary windings are needed in the circuit to obtain the desired results. However, in some situations it may be useful to include windings at more than one of the locations designated by blocks A-I in a particular circuit. Therefore it is to be understood blocks A-I of the above described FIG. 11 may at times be used in combination with each other. For example, a circuit may obtain beneficial results by connecting an auxiliary winding at block location A and block location G.

Figure 12:
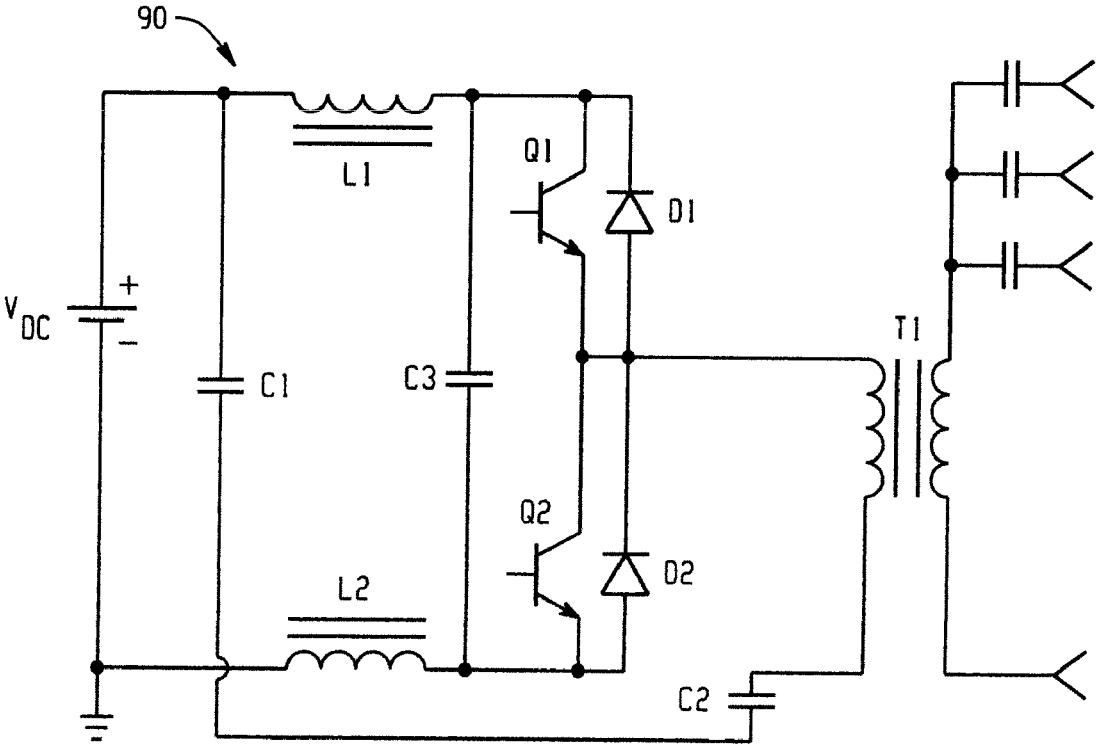
Fig. 12 PRIOR ART
FIG. 12 illustrates a prior art current-fed, half-bridge topology different from FIG. 2.

Turning to FIG. 12, depicted is another known prior art current-fed, half-bridge ballast circuit topology 90 somewhat different from that shown in FIG. 1. Particularly, in this ballast circuit capacitor arrangement C1, C2 is arranged in series instead of having a center-tap between C1 and C2 connecting to the primary of T1 and C4. Thus in this design C2 connects directly to the primary of T1.

Figure 13:
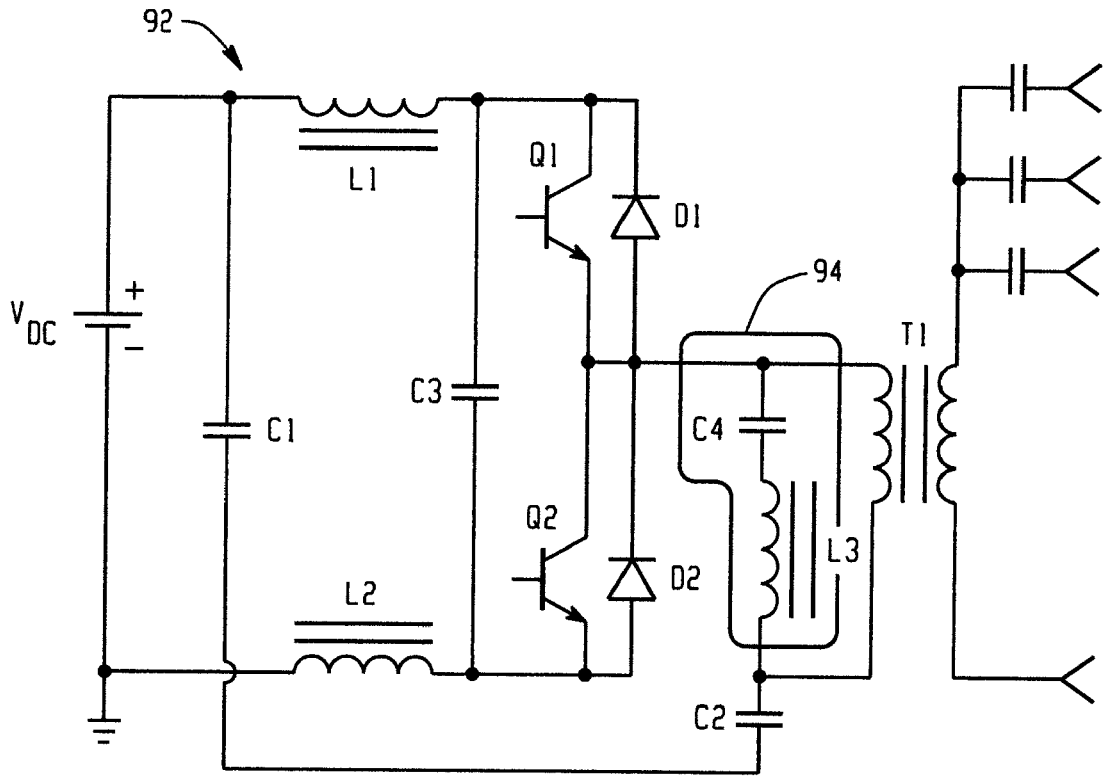
FIG. 13 depicts an anti-striation circuit based on the topology of FIG. 12.

FIG. 13 illustrates a circuit 92 similar to circuit 90 of FIG. 12, but which includes anti-striation features which to generate an asymmetric lamp current. In particular, highlighted section 94 of circuit 92 includes auxiliary winding L3 and capacitor C4 coupled between the output line to transformer T1 and C2. This arrangement creates an imbalance within the resonant tank circuit of the half-bridge topology resulting in an asymmetric output current to the lamp system.

Figure 14:
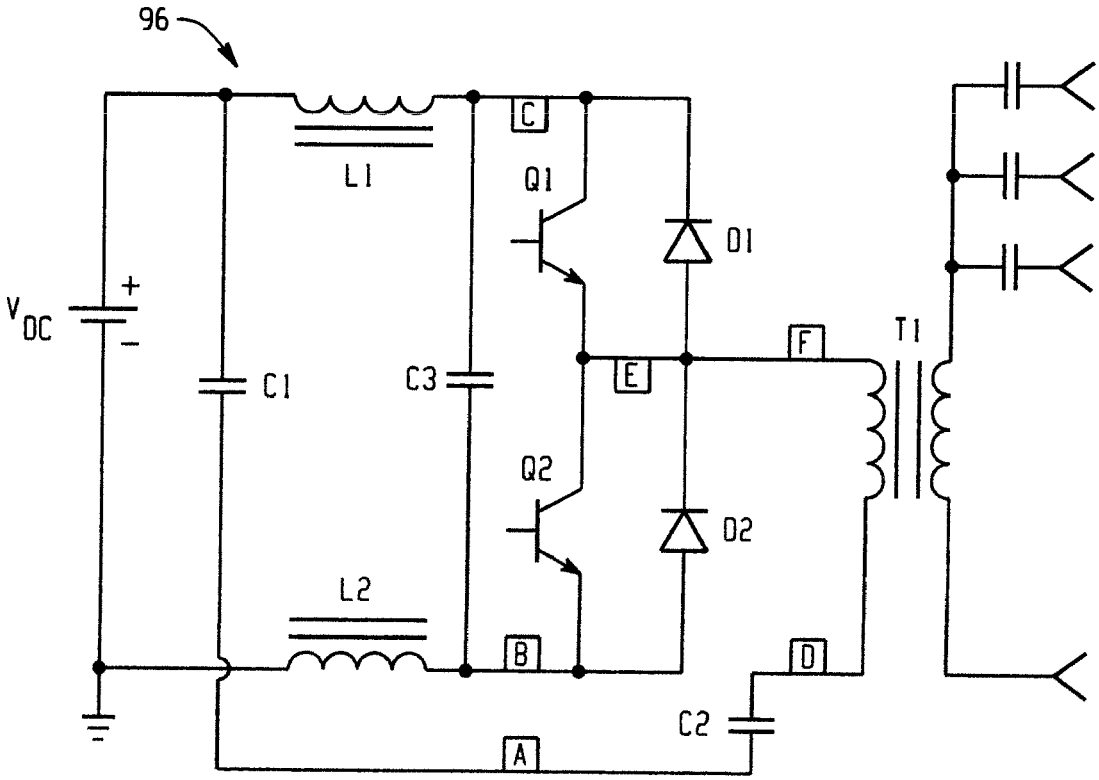
FIG. 14 depicts alternative embodiments for an anti-striation circuit employing auxiliary windings at different locations within the circuit in accordance with the concepts of FIG. 13.
Figure 15:
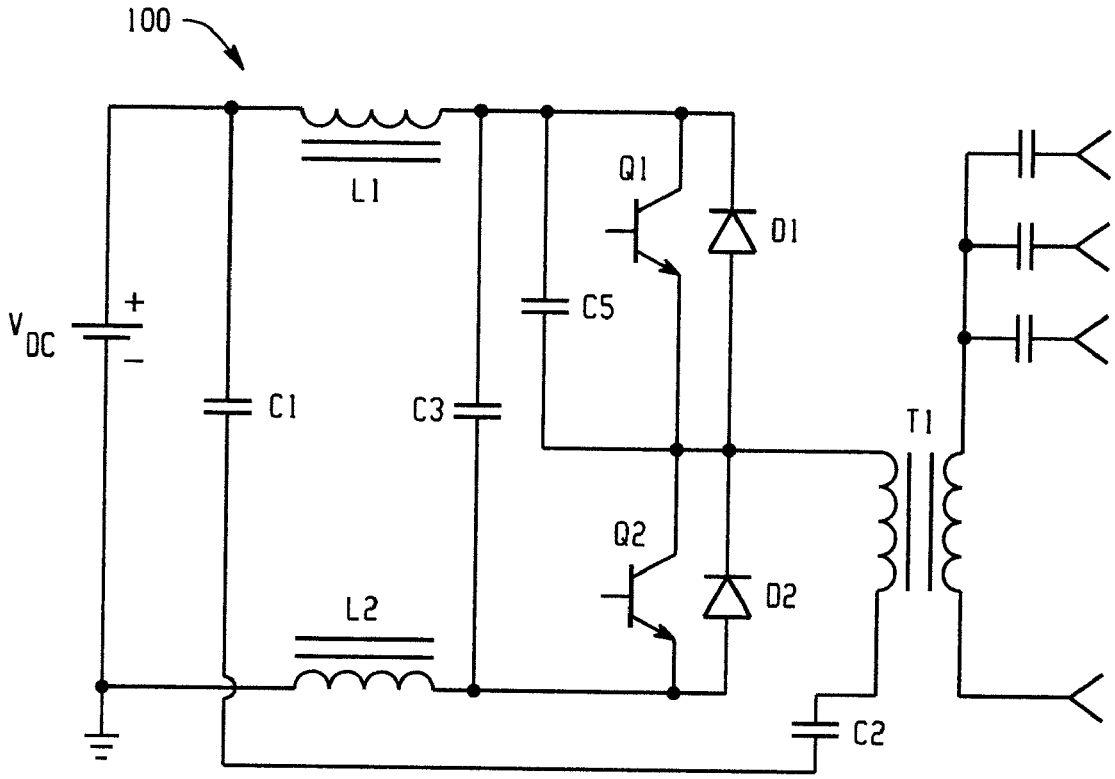
FIGS. 15-18 describe embodiments for anti-striation circuits employing a capacitor element of various arrangements thereof.

Turning to FIG. 14, as illustrated by circuit 96 it has been determined by the inventors the desired asymmetric output may be obtained when inductor L3 is located at variety of locations in the circuit topology, as represented by blocks A-F. Similar to the discussion related to FIG. 11, the desired results may be obtained when just a single location implements the anti-striation components at blocks A-F. However, in some situations benefits may also be obtained by employing such components and a combination of locations represented by blocks A-F in the same circuit.

Figure 16:
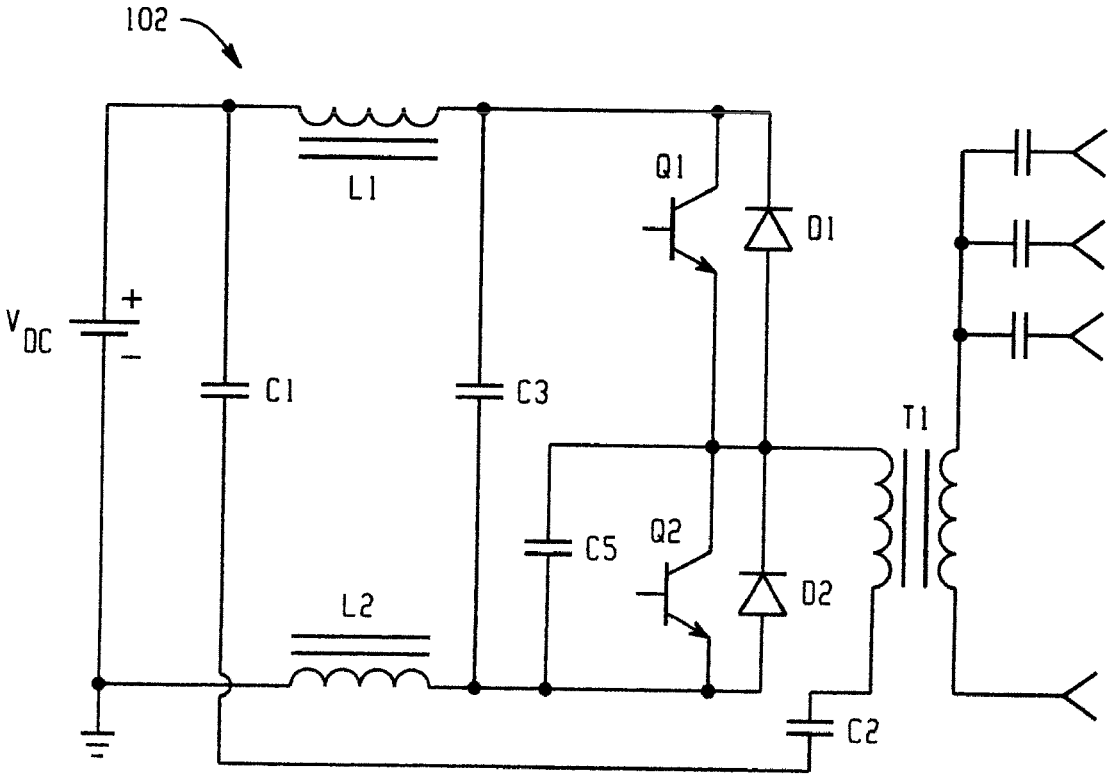
Figure 17:
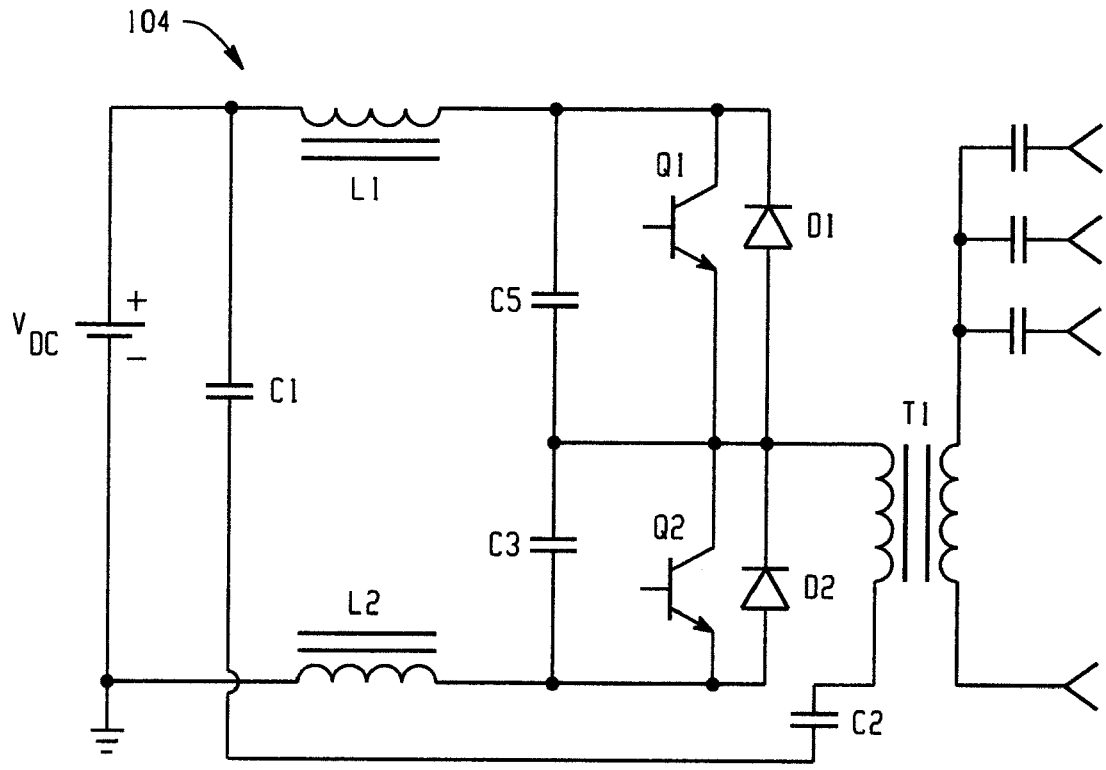
Figure 18:
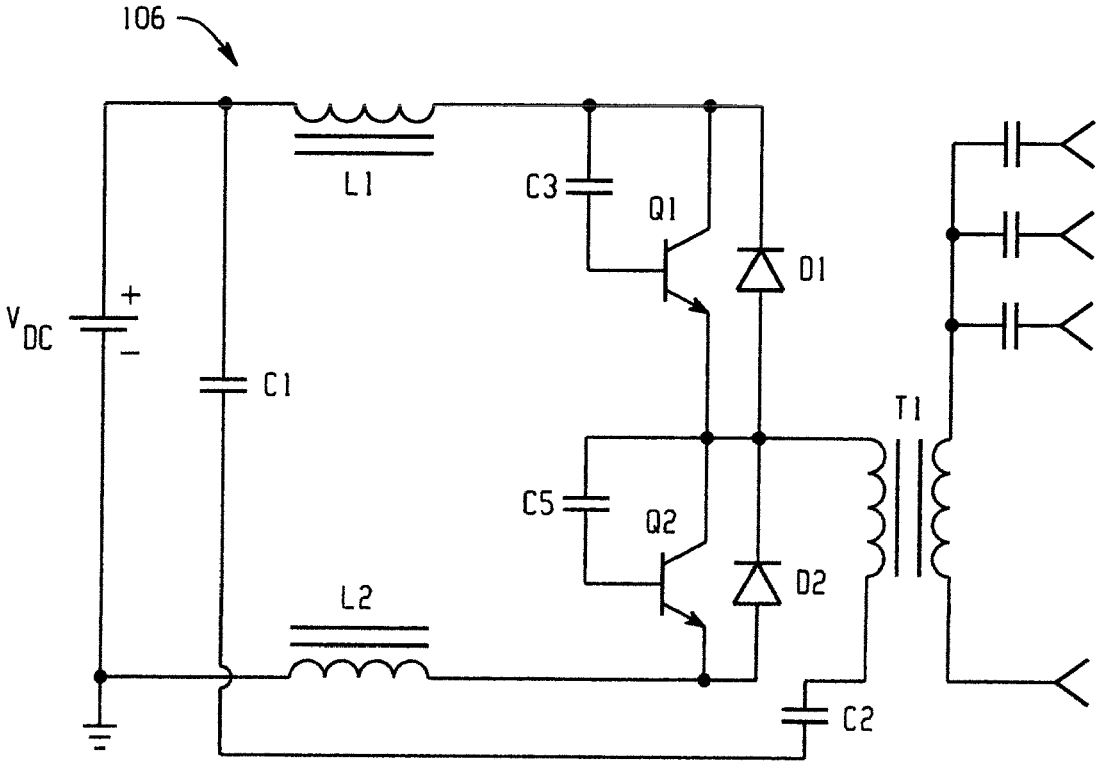

Turning to FIGS. 15-18, illustrated is the understanding the striation solutions proposed in connection with FIGS. 2, 6, 7 and 8, which employ a capacitance, may also be applied to the circuit topology of FIG. 12. Particularly, in FIG. 15 circuit 100 includes capacitor C5 connected in parallel with switch Q1. FIG. 16 shows capacitor C5 of circuit 102 connected in parallel with switch Q2. In FIG. 17, capacitor C3 and capacitor C5 of circuit 104 are connected to the output line to winding T1, and in FIG. 18, it is shown that capacitors C3 and C5 of circuit 106 are connected, respectively, in parallel to or across switches Q1 and Q2 (see FIG. 8), at the same time. In the design of FIG. 18 capacitors C3 and C5 have different values.

Figure 19:
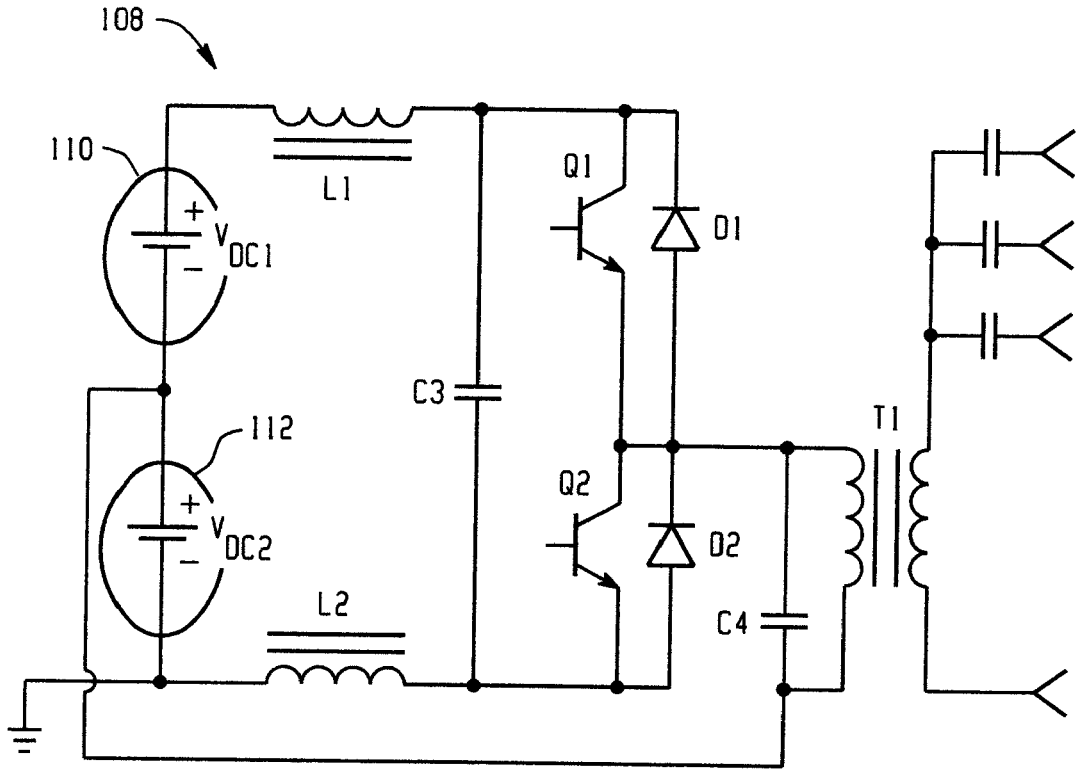
FIG. 19 illustrates a further solution to generate asymmetric lamp current by the employment of unequal voltage sources.

Turning to FIG. 19 yet another embodiment of the present application, as applicable to a current-fed, half-bridge circuit such as in FIG. 1, is shown by circuit 108. In this design, the asymmetric lamp current is obtained by using two separate voltage sources 110 and 112 having unequal voltages.

Figure 20:
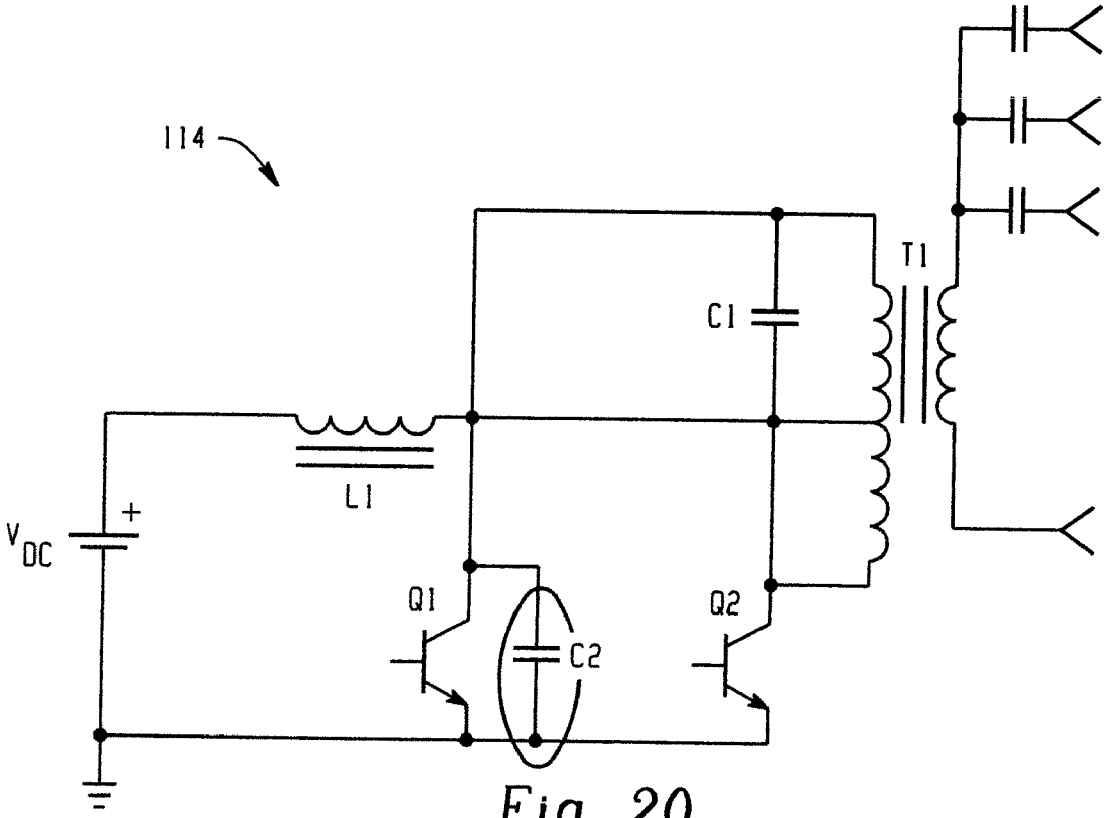
FIG. 20 illustrates an anti-striation circuit within a push-pull circuit.

In FIG. 20, still a further embodiment of the concepts of the present application is illustrated by circuit 114 wherein an asymmetric resonance is obtained by use of additional circuitry, for example, in a known push-pull ballast circuit. As depicted in FIG. 20, electronic ballast circuit 114 having the anti-striation features in accordance with the present application includes additional component C2 in parallel across switch Q1, in order to introduce the asymmetric effect between switches Q1 and Q2.

Figure 21:
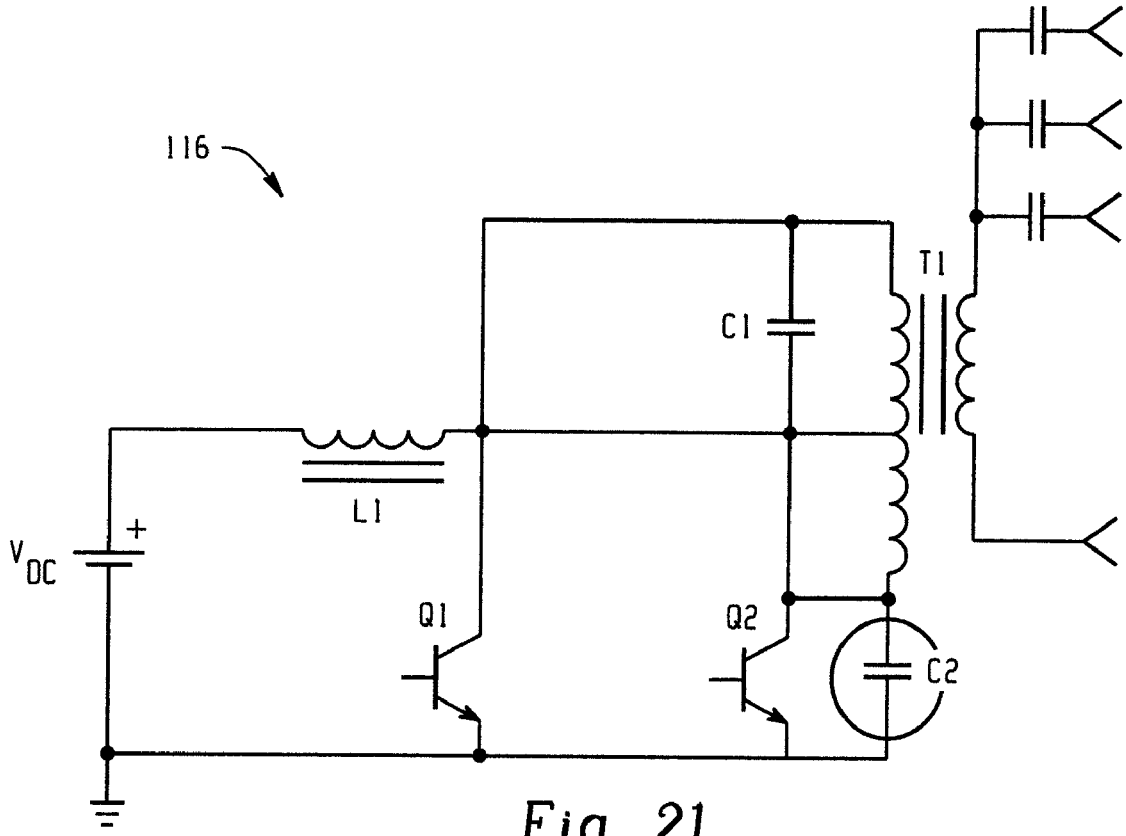
FIG. 21 depicts another embodiment of an anti-striation circuit in a push-pull circuit.

Turning to circuit 116 of FIG. 21, the resonant capacitive component used to obtain the asymmetric output to the lamp system, capacitor C2, is placed in parallel across-switch Q2.

Figure 22:
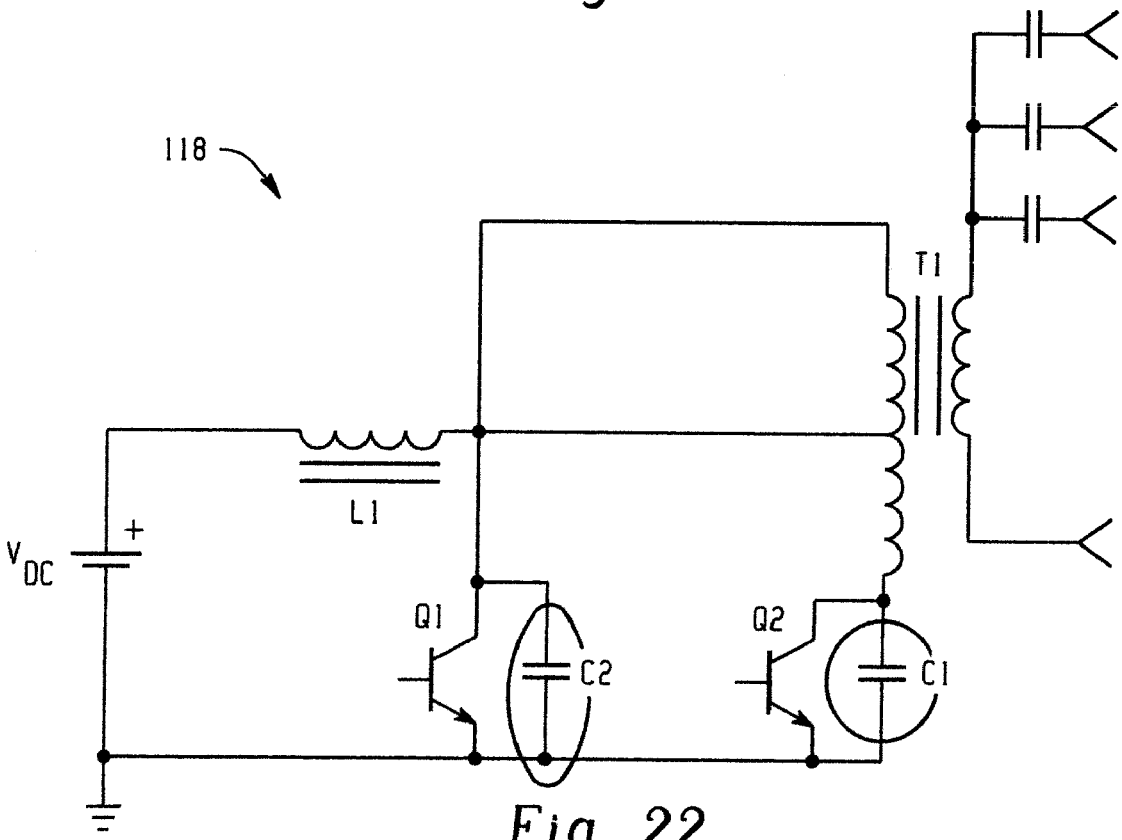
FIG. 22 depicts still a further embodiment of an anti-striation circuit in accordance with the present application employed in a push-pull circuit.

Finally, turning to FIG. 22, depicted is an embodiment of a push-pull circuit 118, wherein capacitors C1 and C2 are each connected in parallel across switches Q1 and Q2, respectively. To obtain the asymmetric output in this embodiment, C1 and C2 are selected to have different values from each other.

A particular aspect of the foregoing embodiments is that the capacitors added to improve the switching operations, such as described in the foregoing, are configured to not have a relationship to the transistors base drive. Rather, they are added as part of the resonant tank circuit portion. This includes FIGS. 8 and 18, as the base drive capacitor is typically not taken as a major resonance capacitor. But rather, it is, along with the other embodiments, one of the non-obvious designs to add a key resonant parameter to existing circuitry, which improves the switching operations of the circuit to minimize striations.

It is to be appreciated while the switches depicted in the foregoing discussion and drawings maybe considered BJTs, it is to be appreciated these are depicted in this manner just for explanation purposes and other switch components maybe used, such as FETs or any other appropriate known switching device. Further, it is to be understood ballast circuits described herein are only exemplary and other designs may benefit from the concepts described herein. Thus while the concepts have been described with reference to the preferred embodiments, obviously modifications and alterations will occur to others upon reading and understanding the preceding detailed description. It is intended that the claims of the present application be construed as including all such modifications and alterations.

What is claimed is:

1. An electronic ballast for providing an asymmetric time-varying electrical output signal to drive at least one lamp, the electronic ballast comprising:

an input circuit with first and second input terminals receiving an input from a power source, the input circuit including a first capacitor coupled between the first input terminal and an intermediate node, a second capacitor coupled between the intermediate node and the second input terminal, a first inductor coupled between the first input terminal and a first bus node, and a second inductor coupled between the second input terminal and a second bus node;

a switching circuit operatively coupled between the bus nodes and an output terminal to selectively couple alternate ones of the bus nodes with the output node to create a time-varying output signal at the output node, the switching circuit including:

a first switching device with a first switch terminal coupled with the first bus node, a second switch terminal coupled with the output terminal, and a control terminal actuated to render the first switching device conductive in one half-cycle of the switching circuit operation, and a second switching device with a first switch terminal coupled with the output terminal, a second switch terminal coupled with the second bus node, and a control terminal actuated to render the first switching device conductive in another half-cycle of the switching circuit operation;

a resonant circuit including:

a transformer primary winding coupled between the output terminal and the intermediate node, a resonant capacitor coupled in parallel with the transformer primary winding between the output terminal and the intermediate node, and an anti-striation circuit separate from the control terminals of the switching devices and coupled between the output terminal and at least one of the first bus terminal, the second bus terminal, and the intermediate node, the anti-striation circuit including at least one anti-striation component active to change a resonant frequency of the resonant circuit in a first portion of a resonant cycle and inactive in a second portion of the resonant cycle to cause the switching circuit to generate an asymmetric time-varying output signal at the output node; and an output circuit for outputting the asymmetric output signal to a lamp system.

2. The electronic ballast of claim 1, wherein the anti-striation circuit includes:

a first anti-striation capacitor coupled between the output terminal and the first bus terminal; and a second anti-striation capacitor coupled between the output terminal and the second bus terminal, the first and second anti-striation capacitors having different capacitances.

3. The electronic ballast of claim 1, wherein the anti-striation circuit includes a choke coupled in series with the resonant capacitor, with a series combination of the choke and the resonant capacitor coupled in parallel with the transformer primary winding between the output terminal and the intermediate node.

4. The electronic ballast of claim 1, further comprising a third capacitor coupled across the first and second bus nodes.

5. The electronic ballast of claim 1, wherein the ballast is a current-fed half-bridge inverter type ballast.

6. The electronic ballast of claim 1, wherein the anti-striation circuit includes an anti-striation capacitor coupled between the output terminal and one of the first and second bus terminals.

7. The electronic ballast of claim 6, wherein the anti-striation capacitor is coupled between the output terminal and the first bus terminal.

8. The electronic ballast of claim 6, wherein the anti-striation capacitor is coupled between the output terminal and the second bus terminal.

9. An electronic ballast for providing an asymmetric time-varying electrical output signal to drive at least one lamp, the electronic ballast comprising:

an input circuit with first and second input terminals receiving an input from a power source, the input circuit including a first capacitor coupled between the first input terminal and an intermediate node, a second capacitor having a first terminal coupled to the intermediate node and a second terminal, a first inductor coupled between the first input terminal and a first bus node, and a second inductor coupled between the second input terminal and a second bus node;

a switching circuit operatively coupled between the bus nodes and an output terminal to selectively couple alternate ones of the bus nodes with the output node to create a time-varying output signal at the output node, the switching circuit including:

a first switching device with a first switch terminal coupled with the first bus node, a second switch terminal coupled with the output terminal, and a control terminal actuated to render the first switching device conductive in one half-cycle of the switching circuit operation, and a second switching device with a first switch terminal coupled with the output terminal, a second switch terminal coupled with the second bus node, and a control terminal actuated to render the first switching device conductive in another half-cycle of the switching circuit operation;

a resonant circuit including:

a transformer primary winding coupled between the output terminal and the second terminal of the second capacitor, and an anti-striation circuit separate from the control terminals of the switching devices and coupled between the output terminal and at least one of the first bus terminal, the second bus terminal, and the second terminal of the second capacitor, the anti-striation circuit including at least one anti-striation component active to change a resonant frequency of the resonant circuit in a first portion of a resonant cycle and inactive in a second portion of the resonant cycle to cause the switching circuit to generate an asymmetric time-varying output signal at the output node; and an output circuit for outputting the asymmetric output signal to a lamp system.

10. The electronic ballast of claim 9, wherein the anti-striation circuit includes a choke and an anti-striation capacitor coupled in series with one another, with the series combination of the choke and the anti-striation capacitor being coupled in parallel with the transformer primary winding between the output terminal and the second terminal of the second capacitor.

11. The electronic ballast of claim 9, wherein the anti-striation circuit includes:

a first anti-striation capacitor coupled between the output terminal and the first bus terminal; and a second anti-striation capacitor coupled between the output terminal and the second bus terminal, the first and second anti-striation capacitors having different capacitances.

12. The electronic ballast of claim 9, further comprising a third capacitor coupled across the first and second bus nodes.

13. The electronic ballast of claim 9, wherein the ballast is a current-fed half-bridge inverter type ballast.

14. The electronic ballast of claim 9, wherein the anti-striation circuit includes coupled an anti-striation capacitor coupled between the output terminal and one of the first and second bus terminals.

15. The electronic ballast of claim 14, wherein the anti-striation capacitor is coupled between the output terminal and the first bus terminal.

16. The electronic ballast of claim 14, wherein the anti-striation capacitor is coupled between the output terminal and the second bus terminal.

17. An electronic ballast for providing an asymmetric time-varying electrical output signal to drive at least one lamp, the electronic ballast comprising:

first and second DC power sources coupled in series, the first and second power sources having unequal voltages;

an input circuit with first and second input terminals receiving an input from the first and second series connected power sources, the input circuit including a first inductor coupled between the first input terminal and a first bus node, and a second inductor coupled between the second input terminal and a second bus node;

a switching circuit operatively coupled between the bus nodes and an output terminal to selectively couple alternate ones of the bus nodes with the output node to create a time-varying output signal at the output node, the switching circuit including:

a first switching device with a first switch terminal coupled with the first bus node, a second switch terminal coupled with the output terminal, and a control terminal actuated to render the first switching device conductive in one half-cycle of the switching circuit operation, and a second switching device with a first switch terminal coupled with the output terminal, a second switch terminal coupled with the second bus node, and a control terminal actuated to render the first switching device conductive in another half-cycle of the switching circuit operation;

a resonant circuit including:

a transformer primary winding coupled between the output terminal and an intermediate node between the first and second power sources, and a resonant capacitor coupled in parallel with the transformer primary winding between the output terminal and the intermediate node; and an output circuit for outputting the asymmetric output signal to a lamp system.

18. The electronic ballast of claim 17, further comprising a third capacitor coupled across the first and second bus nodes.

19. The electronic ballast of claim 17, wherein the ballast is a current-fed half-bridge inverter type ballast.

20. A method of providing an asymmetric time-varying electrical output signal to drive at least one lamp, the method comprising:

inputting power to an input section of the electronic ballast;

generating a resonant signal;

creating a time-varying output signal at an output node by selectively actuating control terminals of first and second switching devices of a switching circuit in individual half-cycles of the switching circuit operation;

altering the resonant signal using at least one anti-striation component active to change a resonant frequency of the resonant signal in a first portion of a resonant cycle and inactive in a second portion of the resonant cycle to cause the switching circuit to generate an asymmetric time-varying output signal at the output node; and outputting the asymmetric output signal to a lamp system to generate an asymmetric current lamp signal.

* * * * *